United States Patent [19]

Jackson

[11] 4,350,936

[45] Sep. 21, 1982

[54] CASCADED FIN WINDING MACHINE CONTROL AND METHOD

[75] Inventor: Dale E. Jackson, Clay, N.Y.

[73] Assignee: Carrier Corporation, Syracuse, N.Y.

[21] Appl. No.: 247,965

[22] Filed: Mar. 26, 1981

[51] Int. Cl.[3] ..... B65H 59/38

[52] U.S. Cl. ..... 318/7; 318/6; 318/45; 318/49

[58] Field of Search ..... 318/6, 7, 45, 49; 72/17, 183; 29/157.3 A, 157.3 AH; 226/42, 44, 178

[56] References Cited

U.S. PATENT DOCUMENTS

| | | | |
|---|---|---|---|
| 794,433 | 7/1905 | Thibodeau | 72/17 |
| 2,978,196 | 4/1961 | McCoy et al. | 242/45 |
| 3,134,166 | 5/1974 | Venables | 29/157.3 |
| 3,185,908 | 5/1965 | Hollis | 318/6 |
| 3,531,962 | 10/1970 | Menasoff | 72/17 |
| 3,550,235 | 12/1970 | Jarvis et al. | 29/157.3 |
| 3,613,975 | 10/1971 | Knight | 226/25 |
| 3,667,664 | 6/1972 | Schroeder | 226/44 X |
| 3,688,375 | 9/1972 | Venables | 29/202 D |
| 3,808,789 | 5/1974 | Hurley | 57/58.7 |
| 3,811,304 | 5/1974 | Gorker | 72/17 |
| 3,985,054 | 10/1976 | Marino | 83/303 |
| 4,079,611 | 3/1978 | Osterkorn | 72/17 |

*Primary Examiner*—Ulysses Weldon

*Attorney, Agent, or Firm*—J. Raymond Curtin; Robert P. Hayter

[57] ABSTRACT

Apparatus and a method for controlling the operation of a fin winding machine. Various motor drives are utilized to regulate the speed of rotation of a heat exchange tube upon which fin is wrapped to regulate the speed of rotation of forming wheels for bending the fin to the appropriate configuration and to regulate the speed of rotation of slitter wheels for perforating the fin prior to bending. Sensing means are provided for determining the length of the fin strip within various segments along a fin route such that the motor speeds are all adjusted to maintain the desired amount of fin strip. Tension means are provided for maintaining constant tension of the fin strip regardless of the length of the fin strip in the appropriate segment. The various sensing means are cascaded such that a change in speed of one motor may affect a change in speed of another motor.

12 Claims, 1 Drawing Figure

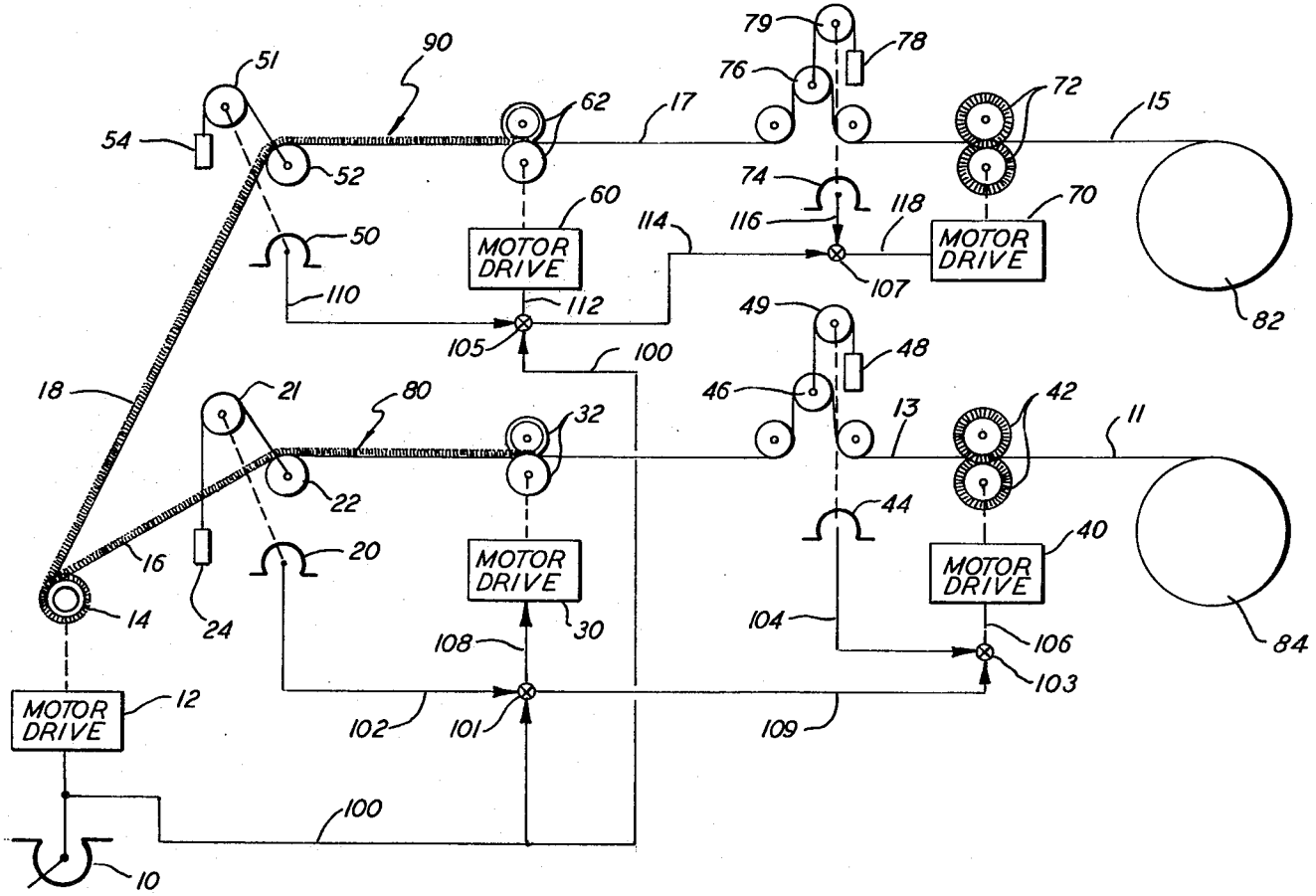
MOTOR DRIVE
MOTOR DRIVE
MOTOR DRIVE
MOTOR DRIVE
MOTOR DRIVE

CASCADED FIN WINDING MACHINE CONTROL AND METHOD

BACKGROUND OF THE INVENTION

1. Field of the Invention

This invention relates to a method and apparatus for winding a fin ribbon onto a rotating tube to form a heat exchanger. More particularly the present invention concerns a control for regulating various motor drives to allow for high speed heat exchanger manufacture.

2. Prior Art

A wound fin heat exchanger is formed by winding a fin ribbon about the outer surface of a cylindrical heat exchange tube to provide a heat exchanger. The ribbon is normally formed in an L-shape or U-shape having fin portions projecting upwardly and is wound about the tube with a flat base portion in heat exchange relation with the exterior cylindrical surface of the tube. The projecting fins promote the transfer of heat energy between a gas flowing over the exterior surface of the tube and a fluid flowing through the tube. The fin ribbon is typically narrow in thickness and may be made of any heat transfer material although aluminum has been found particularly advantageous.

Various methods of applying fin ribbon to the tube include both rotating the tube allowing the fin ribbon to be wound thereabout and rotating the fin ribbon about the tube. In those applications wherein the tube is rotated it is common to advance a fin strip from a reel of solid sheet stock and to both slit the fin strip to form perforations to define the projecting fin projections and to form or bend the fin stock to the appropriate configuration for application to the tube. A single continuous fin ribbon normally extends from the reel of fin stock to the tube on which it is wound. The slitting and forming operations are accomplished in a continuous fashion as the fin strip passes along a fin strip route.

It is advantageous to utilize a fin strip of minimum thickness which may be applied at a high rate of speed without breaking. The thickness of the material is minimized to reduce the amount of material necessary to provide a preselected amount of heat transfer. The rate of application is increased to decrease the amount of fin winding machinery necessary to produce a desired quantity of heat exchange surface.

To provide both a minimum thickness of fin stock and a high speed winding operation it is necessary to maintain strict control of the various operations occurring along the fin strip route. By maintaining strict control of the operations sufficient stress to break the fin strip is avoided while sufficient tension to assure the fin strip is wound appropriately about the heat exchange tube is provided. The control described herein provides a cascaded system wherein a master control is utilized to set the speed of a motor driving a rotating tube. Feedback means are used to sense the amount of fin stock between the wrapping location where the fin is wrapped onto the tube and the forming wheels where the fin strip is bent to the appropriate configuration. This feedback means is utilized to generate a signal in combination with the master signal to regulate the speed of the motor driving the forming wheels. In addition thereto the amount of fin stock between the forming wheels and the slitter wheels where the fin strip is perforated to define the fin projections is also determined with a second feedback signal generated in response thereto. This signal is combined with the signal generated from the first feedback means and from the master signal to provide an input to regulate the speed of the motor driving the slitter wheels.

SUMMARY OF THE INVENTION

It is an object of the present invention to provide a control for a fin winding machine.

It is a further object of the present invention to regulate the speed of both the forming wheels and slitter wheels in a fin winding machine responsive to both an initial speed signal and feedback means sensing the amount of fin stock between various portions of a fin stock route.

It is a further object of the present invention to provide means for rapidly winding fin stock upon a tube.

It is another object of the present invention to provide a control means which allows fin stock of minimum thickness to be rapidly wrapped about an advancing heat exchange surface.

It is a still further object of the present invention to provide a safe, economical, reliable and easy to maintain control system and method of operation for regulating the operation of a fin winding machine.

Other objects will be apparent from the description to follow and the appended claims.

The above objects are achieved according to a preferred embodiment of the invention by the provision of a fin winding machine having a wrapping motor rotating a tube, a motor driving forming wheels and a motor driving slitting wheels. A dancer type feedback means is located to sense the amount of fin stock between the tube and the forming wheels. A second dancer type feedback means is located between the forming wheels and the slitter wheels to sense the length of fin stock therebetween. A master speed control is selected to provide a signal to the motor drive of the wrapping motor to establish an overall system speed. This master speed signal is combined with a signal from the first dancer to provide an input signal to the motor drive of the forming wheels. The master signal and the signal from the first dancer are combined with the signal from the second dancer to provide an input signal to the motor drive of the slitter wheels. By cascading the input signals as described the appropriate motors are operated at respective speeds to advance a fin strip along a fin strip route without breaking at a high rate of speed.

BRIEF DESCRIPTION OF THE DRAWING

FIG. 1 is a diagramatic view of a fin winding machine and controls as set forth herein.

DETAILED DESCRIPTION OF THE PREFERRED EMBODIMENT

The controls for and method of operation of a fin winding machine are set forth in reference to a particular embodiment. It is to be understood that the geometrical relation of the various components as well as the shape of the fin stock, the bending done by the forming wheels, the specifics of the slitter wheels, the exact location of the dancers, the selection of motor drives and the number of fin strips being simultaneously wound on the heat exchanger are all subject to selection within the scope of the present invention.

It can be seen in FIG. 1 that tube 14 has fin strips 80 and 90 wound helically thereabout as the tube is rotated and advanced. Motor drive 12 is connected to a wrapping motor (not shown) for rotating tube 14.

Reel 84 has a large amount of fin stock wound thereabout and is the beginning of the fin strip route. Fin strip 80 being a smooth planar strip (planar portion 11) emerges from reel 84 and passes between slitter wheels 42. The slitter wheels have teeth extending therefrom to perforate both edges of the fin strip while leaving the center of the strip unaffected. From the slitter wheels the fin strip 80 now slit (referenced as portion 13) passes over guide pulley 46 to forming wheels 32. At forming wheels 32 the solid center portion of strip 80 is maintained flat while the edge slit portions are bent upwardly such that the flat fin of portion 13 is discharged from the forming wheels 32 in a U-shaped configuration with the fins extending upwardly. The strip with fins 16 then passes over pulley 22 in fin strip portion 16 and is wound about tube 14.

A second similar fin strip route is also disclosed having reel 82 and fin strip 90. Fin strip 90 having planar portion 15 passes through slitter wheels 72 over guide pulley 76 through forming wheels 62 and over pulley 52 before being wound at fin portion 18 onto tube 14.

Pulley 22 is a guide pulley adapted to be connected to weight 24. Weight 24 is connected to pulley 22 by a linkage which runs over pulley 21. Weight 24 acts to apply constant tension to pulley 22 such that a constant tension is applied to the fin strip between the forming rolls and the tube. Pulley 21 has potentiometer 20 mounted to sense any rotational displacement thereof. Potentiometer 20 may be a rotational device which emits a signal of varying intensity depending upon the rotational position of pulley 21. Guide pulley 46 is connected by linkage to weight 48. This linkage runs over pulley 49 which is likewise connected to potentiometer 44 for sensing the position of guide pulley 46. Weight 48 acts to provide a constant tension on fin strip portion 13 as it runs from the slitter wheels 42 to the forming wheels 32. Hence, it can be seen that the tension in the fin strip is controlled both between tube 14 and forming wheels 32 at one level and between slitter wheels 42 and forming wheels 32 at a second level. The tension on each segment is determined by the weight acting on the guide pulley.

The second fin strip route is identical to the first in that weight 54 is connected to guide pulley 52 via a linkage passing over pulley 51. Potentiometer 50 is connected to pulley 51 to sense the rotational position thereof. Additionally, guide pulley 76 is connected via a linkage to weight 78. The linkage runs over pulley 79 which is connected to potentiometer 74 for generating a signal indicative of the position of guide pulley 76.

Forming wheels 32 and 62 are driven by their respective forming motors (not shown). Slitter wheels 42 and 72 are likewise driven by their respective slitter motors (not shown). Motor drive 30 is connected to the forming motor which drives forming wheels 32. Motor drive 60 is connected to the forming motor for driving forming wheels 62. Motor drive 40 is connected to the slitter motor for driving slitter wheels 42 and motor drive 70 is connected to the slitter motor for driving slitter wheels 72. Each motor drive is capable of changing the speed of a motor. The speed of the appropriate wheels may be regulated to maintain the appropriate length of the fin strip between the forming wheels and the tube or between the slitter wheels and the forming wheels. The individual motor drives may be a motor drive that is commercially available such as a Model 3124 Single Phase Regenerative Drive produced by the Electroflyte Division of Black Clawsen located in Fulton, N.Y.

As part of the electrical circuit a master speed control potentiometer 10 is used to select the overall machine speed. The speed control emits a signal to motor drive 12 which regulates the speed of the wrapping motor (not shown) to rotate the tube. Master speed control 10 additionally is connected via line 100 to junctions 101 and 105. Potentiometer 20 is connected by line 102 to junction 101. Line 108 connects junction 101 to motor drive 30. Line 109 connects junction 101 to junction 103. Line 104 connects potentiometer 44 to junction 103. Line 106 connects junction 103 to motor drive 40. Line 110 connects potentiometer 50 to junction 105. Line 112 connects junction 105 to motor drive 60. Line 114 connects junction 105 to junction 107. Line 116 connects potentiometer 74 to junction 107. Junction 107 is connected to motor drive 70 via line 118.

Operation

Upon a preselected motor speed being determined master speed control 10 is set to emit a predetermined signal. This signal is transmitted to motor drive 12 which operates the wrapping motor to drive the tube at a predetermined speed. The same signal is conducted over line 100 to junction 101. Additionally, a signal indicative of amount of fin strip between forming wheels 32 and tube 14 as sensed by potentiometer 20 is conducted over line 102 to junction 101. This is a feedback signal indicative of whether there is too little or too much fin strip between these two locations. Junction 101 receives signals from lines 100 and 102, sums the signals and supplies the combined signal to motor drive 30 by line 108. Motor drive 30 then operates the forming motor at the appropriate speed to rotate forming wheels 32 at the appropriate speed. Wire 109 conducts the combination master signal from potentiometer 10 and feedback signal from potentiometer 20 to junction 103. Wire 104 conducts the second feedback signal generated by potentiometer 44 which senses the amount of fin stock between the slitter wheels and the forming wheels to junction 103. The three combined signals are then conducted by wire 106 to motor drive 40 which regulates the speed of the slitter motor driving slitter wheels 42.

The master speed control signal conducting over wire 100 is also conducted to junction 105. The signal conducted over wire 110 from potentiometer 50 is also conducted to junction 105 and is indicative of the amount of fin strip between forming wheels 62 and tube 14. The combination of these two signals is conducted over wire 112 to motor drive 60 for controlling the speed of the forming motor driving the forming wheels 62. The combined signal from wires 100 and wire 110 is conducted over wire 114 to junction 107. Additionally, the signal from potentiometer 74 indicating the amount of fin strip between slitter wheels 72 and forming wheel 62 is conducted to junction 107. These combined signals are then conducted over wire 118 to motor drive 70 for regulating the speed of the motor driving slitter wheels 72.

It can be seen that the master signal controls the overall rate of the system and that each individual fixed fin strip portion has a feedback means for regulating the speed of the motor driving either the forming wheels for fin strip portions 16 and 18 or the slitter wheels for fin strip portions 13 and 17. That the appropriate amount of fin stock is continually maintained between the tube and the forming wheels and the forming wheels and the slitter wheels.

Weights 24, 54, 48 and 78 apply a force to the pulleys to which they are connected such that a known tension is always applied to the fin strip. Hence, the fin strip may be wound about tube 14 always at the same tension regardless of the amount of fin strip between tube 14 and forming wheels 32.

When the amount of fin stock strip between the forming wheels 32 and tube 14 increases pulley 22 raises and weight 24 lowers. As the weight 24 and pulley 22 move the linkage traveling over pulley 21 causes pulley 21 to rotate. As pulley 21 rotates the signal emitted from potentiometer 20 connected to pulley 21 changes. As pulley 22 raises the signal emitted from potentiometer 20 decreases such that the motor drive 30 will act to decrease the speed of the motor driving the slitter wheels. This decrease in speed will act to reduce the amount of fin strip between the forming wheels and tube 14 such that pulley 22 then moves downwardly and weight 24 moves upwardly. As the length of the fin strip decreases further pulley 22 continues to move downwardly rotating potentiometer 20 and increasing the signal emitted from potentiometer 20. The increasing signal from potentiometer 20 acts in combination with the master control signal to increase the motor speed and the speed of forming wheels 32. Hence, movement in either direction of the pulley 22 acts to either decrease or increase the speed of forming wheels 32 such that the amount of fin strip between tube 14 and forming wheel 32 is always maintained within a predetermined range. All this movement of the pulley is accomplished with a constant tension being applied to the fin strip via weight 24.

Potentiometer 44 sensing the position of guide pulley 46 acts in an identical manner. As the guide pulley 46 moves downwardly the potentiometer signal changes to increase the speed of slitter wheels 42. As the guide pulley 46 moves upwardly the potentiometer signal changes to decrease the speed of slitter wheels 42 to decrease the amount of fin strip between the slitter wheels and the forming wheels.

As described above it can be seen that the various controls along the fin strip route are cascaded to affect the various motor speeds. The signal used to drive the slitter motor is responsive to the overall master speed signal, the signal received from potentiometer 20 indicative of the speed of the forming wheels and the signal emitted by potentiometer 44. Hence, any change in the signal emitted by potentiometer 20 not only affects the speed of forming wheels 32 but likewise the speed of slitter wheels 42. The second fin strip 90 acts in an identical manner to the first fin strip 80.

It is to be understood that variations and modifications can be effected within the spirit and scope of the present invention.

What is claimed is:

1. A method of controlling the tension in a fin strip which is slit by a pair of slitter wheels driven by a slitter motor, which is formed by a pair of forming wheels driven by a forming motor and which is wrapped about a tube rotated via a wrapping motor and wherein each motor has a motor drive for regulating the speed of the motor which comprises the steps of:

setting a speed control to generate a master signal for controlling the operation of the wrapping motor;

generating a first signal in response to a condition of the fin strip between the tube and the forming wheels;

combining the master signal and the first signal to serve as an input signal to the forming motor motor drive for regulating the speed of the forming motor;

generating a second signal in response to a condition of the fin strip between the forming wheels and the slitter wheels; and combining the master signal, the first signal and the second signal to serve as an input signal to the slitter motor motor drive for regulating the speed of the slitter motor.

2. The method as set forth in claim 1 wherein the step of generating a first signal includes sensing the length of the fin strip between the tube and forming wheels and wherein the step of generating a second signal includes sensing the length of the fin strip between the forming wheels and the slitter wheels.

3. The method as set forth in claim 2 and further including the steps of maintaining the tension in the fin strip constant between the tube and the forming wheels; and sustaining the tension in the fin strip constant between the forming wheels and the slitter wheels.

4. The method as set forth in claim 3 wherein the step of sustaining includes:

passing the fin strip over a movable guide pulley; and providing a constant force on the guide pulley with a weight connected to the guide pulley such that a constant force is applied to the fin strip as the guide pulley moves in response to the varying lengths of the fin strip.

5. The method as set forth in claim 4 wherein the step of generating a second signal includes generating the signal in response to the position of the fin strip by determining the position of the guide pulley.

6. A method of controlling the tension in multiple fin strips including a first fin strip which is slit by a first pair of slitter wheels driven by a first slitter motor, formed by a first pair of forming wheels driven by a first forming motor; a second fin strip which is slit by a second pair of slitter wheels driven by a second slitter motor, formed by a second pair of forming wheels driven by a second forming motor; both the first fin strip and the second fin strip being wrapped about a tube rotated via a wrapping motor and wherein each motor has an accompanying motor drive for regulating the speed of the motor which comprises the steps of:

setting a speed control to generate a master signal for controlling the operation of the wrapping motor;

generating a first signal in response to a condition of the first fin strip between the tube and the first forming wheels;

combining the master signal and the first signal to serve as an input signal to the first forming motor motor drive for regulating the speed of the first forming motor;

generating a second signal in response to a condition of the first fin strip between the first forming wheels and the first slitter wheels;

combining the master signal, the first signal and the second signal to serve as an input signal to the first slitter motor motor drive for regulating the speed of the first slitter motor;

generating a third signal in response to a condition of the second fin strip between the tube and the second forming wheels;

combining the master signal and the third signal to serve as an input signal to the second forming motor motor drive;

generating a fourth signal in response to a condition of the second fin strip between the second forming wheels and the second slitter wheels; and combining the master signal, the third signal and the fourth signal to serve as an input signal to the second slitter motor motor drive.

7. The method as set forth in claim 6 wherein the step of generating a second signal comprises:

passing the first fin strip over a first guide pulley;

mounting a first weight to the first guide pulley to maintain a constant tension on the first guide pulley and first fin strip; and sensing the position of the first guide pulley to determine the length of the first fin strip between the first slitter wheels and the first forming wheels; and generating the second signal in response to the sensed position of the first guide pulley.

8. The method as set forth in claim 7 wherein the step of generating a fourth signal comprises:

passing the second fin strip over a second guide pulley;

mounting a second weight to the second guide pulley to maintain a constant tension on the second guide pulley and second fin strip; and sensing the position of the second guide pulley to determine the length of the second fin strip between the second slitter wheels and the second forming wheels; and generating the fourth signal in response to the sensed position of the second guide pulley.

9. Apparatus for winding a fin strip about a heat exchange tube which includes rotating means including a wrapping motor for rotating the tube to wrap the fin thereabout, fin forming wheels and a forming motor for rotating the fin forming wheels to bend the fin strip to the appropriate configuration, slitter wheels for forming at least one perforated edge on the fin strip and a slitter motor for driving the slitter wheels which comprises:

a first motor drive for regulating the speed of the wrapping motor;

a second motor drive for regulating the speed of the forming motor;

a third motor drive for regulating the speed of the slitter motor;

a first feedback means connected to generate a signal indicative of the amount of fin strip between the tube and the fin forming wheels;

a second feedback means connected to generate a signal indicative of the amount of fin strip between the fin forming wheels and the slitter wheels;

a speed control connected to the first motor drive for generating a signal indicative of the desired speed of the wrapping motor;

means for supplying a combined signal from the speed control and the first feedback means to the second motor drive for regulating the speed of the forming motor; and means for supplying a combined signal from the speed control, first feedback means and second feedback means to the third motor drive for regulating the speed of the slitter motor.

10. The apparatus as set forth in claim 9 wherein the second feedback means comprises:

a guide pulley over which the fin strip passes;

a weight connected to the guide pulley for applying constant force to the pulley to maintain a constant tension in the fin strip; and means for generating a signal in response to the location of the guide pulley.

11. The apparatus as set forth in claim 10 wherein the means for generating a signal is a potentiometer mechanically coupled via a linkage between the weight and guide pulley.

12. The apparatus as set forth in claim 9 wherein a second fin strip is simultaneously wound on the heat exchange tube and including second fin forming wheels driven by a second forming motor, and second slitter wheels driven by a slitter motor which further comprises:

a third motor drive for regulating the speed of the second forming motor;

a fourth motor drive for regulating the speed of the second slitter motor;

a third feedback means connected to generate a signal indicative of the amount of second fin strip between the tube and the second forming wheels;

a fourth feedback means connected to generate a signal indicative of the amount of second fin strip between the second forming wheels and the second slitting wheels;

means for supplying a combined signal from the speed control and the third feedback means to the third motor drive for regulating the speed of the second forming motor; and means for supplying a combined signal from the speed control, third feedback means and fourth feedback means to the fourth motor drive for regulating the speed of the second slitter motor.

* * * * *